United States Patent [19]

Harris

[11] Patent Number: 4,655,190

[45] Date of Patent: Apr. 7, 1987

[54] BALL PITCHING MACHINE WITH SELECTIVE ADJUSTMENT BETWEEN DRIVE AND PRESSURE WHEELS

[76] Inventor: Clifford V. Harris, 11010 N. Memorial, Owasso, Okla. 74055

[21] Appl. No.: 827,033

[22] Filed: Feb. 7, 1986

[51] Int. Cl.[4] ..... A63B 69/40

[52] U.S. Cl. ..... 124/78; 273/26 D

[58] Field of Search ..... 124/1, 49, 56, 78; 273/26 D, 29 R

[56] References Cited

U.S. PATENT DOCUMENTS

| | | | |
|---|---|---|---|
| 3,538,900 | 11/1970 | Samuels | 124/78 |
| 3,777,732 | 12/1973 | Holloway et al. | 124/78 |
| 3,878,828 | 4/1975 | Francesco | 124/49 X |
| 4,193,591 | 3/1980 | Paulson | 124/78 |
| 4,352,348 | 10/1982 | Griffith | 124/78 |
| 4,423,717 | 1/1984 | Kahelin | 124/78 |
| 4,524,749 | 6/1985 | Giovagnoli | 124/7 |
| 4,531,504 | 7/1985 | Gilreath | 124/78 |

*Primary Examiner*—Richard T. Stouffer

*Attorney, Agent, or Firm*—Henderson & Sturm

[57] ABSTRACT

A ball pitching machine including a mainframe, a subframe pivotally attached to and selectively tiltable with respect to said mainframe, and a bracket pivotally attached to and selectively pivotable with respect to said subframe. The subframe supports a drive and attached drive wheel while the bracket supports a radially aligned pressure wheel. The bracket includes an A-frame member and the pressure wheel is rotatably supported at its apex. A guide tube having a discharge end disposed intermediate the drive wheel and the pressure wheel directs a ball in contact with the rotating drive wheel. The machine can pitch balls of various diameters such as baseballs and softballs since the spacing between the drive wheel and the pressure wheel is selectively adjustable by pivoting the bracket with respect to the subframe. Also, the amount of pressure applied by the pressure wheel determines the speed at which the ball is ejected from the machine. Further, the trajectory of the ball can be controlled by selectively tilting the subframe with respect to the mainframe.

6 Claims, 5 Drawing Figures

BALL PITCHING MACHINE WITH SELECTIVE ADJUSTMENT BETWEEN DRIVE AND PRESSURE WHEELS

TECHNICAL FIELD

This invention relates to ball pitching machines, and more particularly to such machines which adjustably accommodate balls of different diameters.

BACKGROUND ART

Various ball pitching machines are known which operate to pitch baseballs, softballs, and other similar objects. Due to complex structures, some of these machines are expensive to purchase and maintain, and require skilled personnel to operate them. Also, machines suitable for use by amateurs, such as for recreational use and use by schools, should be inexpensive, reliable, durable and easy to operate. Further, such machines should be designed to accommodate balls of various sizes and have the ability to operate at different speeds.

Those concerned with these and other problems recognize the need for an improved ball pitching machine.

DISCLOSURE OF THE INVENTION

The present invention provides a ball pitching machine including a mainframe, a subframe pivotally attached to and selectively tiltable with respect to said mainframe, and a bracket pivotally attached to and selectively pivotable with respect to said subframe. The subframe supports a drive and attached drive wheel while the bracket supports a radially aligned pressure wheel. A guide tube having a discharge end disposed intermediate the drive wheel and the pressure wheel directs a ball in contact with the rotating drive wheel. The machine can pitch balls of various diameters such as baseballs and softballs since the spacing between the drive wheel and the pressure wheel is selectively adjustable by pivoting the bracket with respect to the subframe. Also, the amount of pressure applied by the pressure wheel determines the speed at which the ball is ejected from the machine. Further, the trajectory of the ball can be controlled by selectively tilting the subframe with respect to the mainframe.

A wheel assembly is carried on the frame and is movable between a raised portion and a lowered ground engaging position. The wheel assembly is lowered and locked in the lowered transport position by a rod which interconnects the wheel assembly and the mainframe. A tongue and handle is attached to the mainframe such that one person can easily move the machine when the wheel assembly is in the lowered position.

An object of the present invention is the provision of an improved ball pitching machine.

Another object is to provide a ball pitching machine that is simple in structure and inexpensive to manufacture.

A further object of the invention is the provision of a ball pitching machine that adjustably accommodates balls of different sizes such as baseballs an softballs.

Still another object is to provide a ball pitching machine wherein the speed of the ball and the trajectory of the ball ejected from the machine is easily and conveniently adjusted.

A still further object of the present invention is the provision of a ball pitching machine that is durable and can be conveniently operated and maintained.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
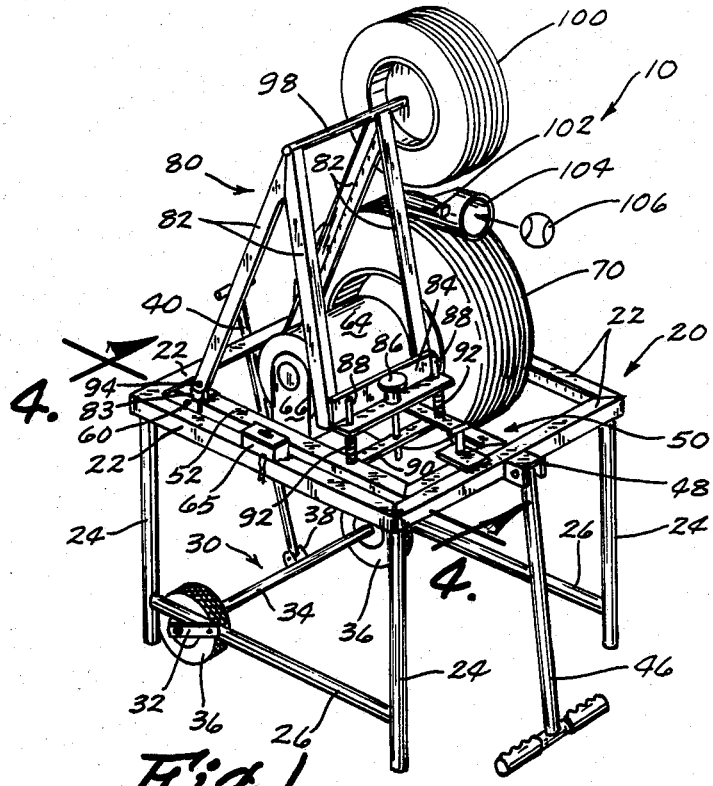
FIG. 1 is a perspective view showing the ball pitching machine of the present invention.

Referring now to the drawings, wherein like reference numerals designate identical or corresponding parts throughout the several views, FIG. 1 shows a ball pitching machine (10) including a mainframe (20), a subframe (50) pivotally attached to and selectively tiltable with respect to the mainframe (20), and a bracket (80) pivotally attached to and selectively pivotable with respect to the subframe (50).

The mainframe (20) includes connected horizontal beams (22) that form an open rectangle supported by legs (24). Horizontal braces (26) interconnect the legs (24) and carry a retractable wheel assembly (30) which is pivotally attached to the braces (26) by straps (32).

Figure 2:
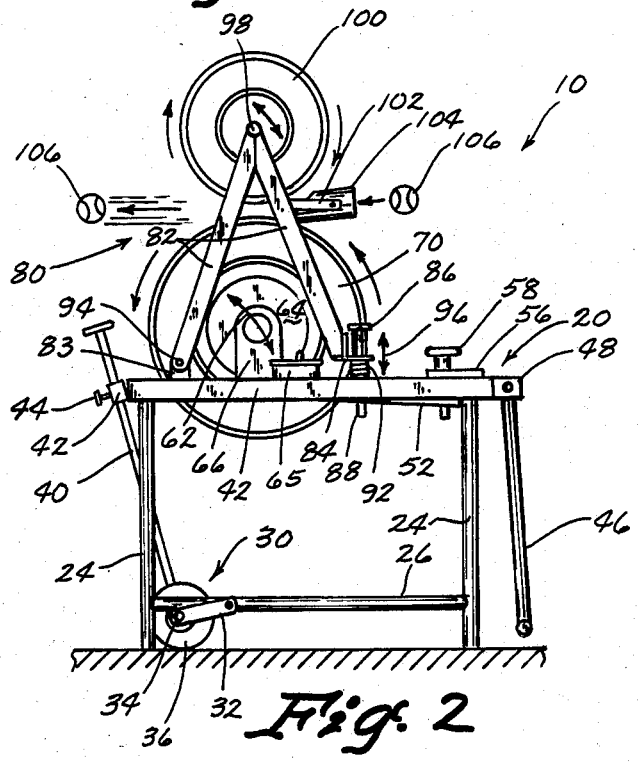
FIG. 2 is a side elevational view thereof.
Figure 3:
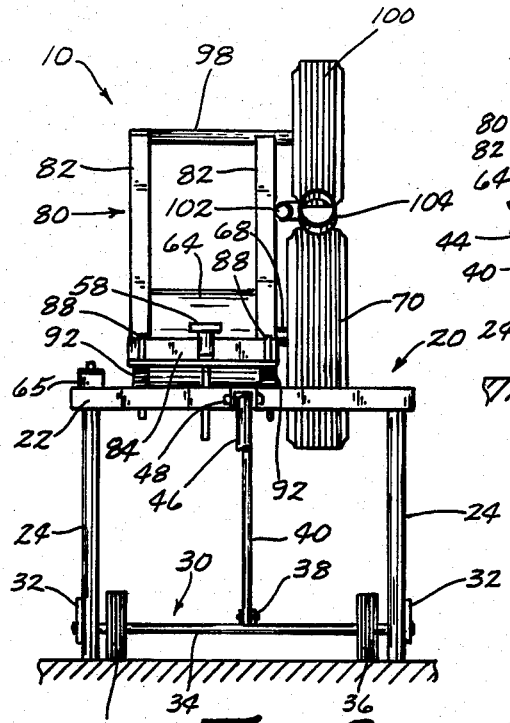
FIG. 3 is a front elevational view having a portion of the front tongue and handle cut away to show the wheel assembly.
Figure 5:
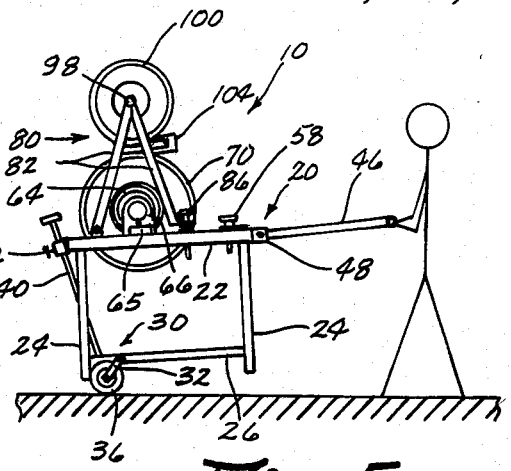
FIG. 5 is a reduced side elevational view illustrating the wheel assembly locked in the lowered position and the tongue and handle extended such that the machine can be transported.

The wheel assembly (30) includes an axle (34) having opposite ends rotatably attached to the ends of the straps (32). Ground engaging wheels (36) are carried near the ends of the axle (34) and a lug (38) is attached to the central portion thereof. A rod (40) has one end pivotally attached to the leg (38) and the opposite end is secured to the rear of the mainframe (20) by a collar (42) and a set screw (44). The wheel assembly (30) is selectively movable between the raised position illustrated in FIGS. 1-3 and the lowered transport position shown in FIG. 5. When in the transport position, the wheel assembly (30) is locked in position by engagement of the set screw (44) with the rod (40). Also, when in the transport position, the tongue and handle (46) is pivoted about its connection to lug (48) to extend forward as illustrated in FIG. 5.

Figure 4:
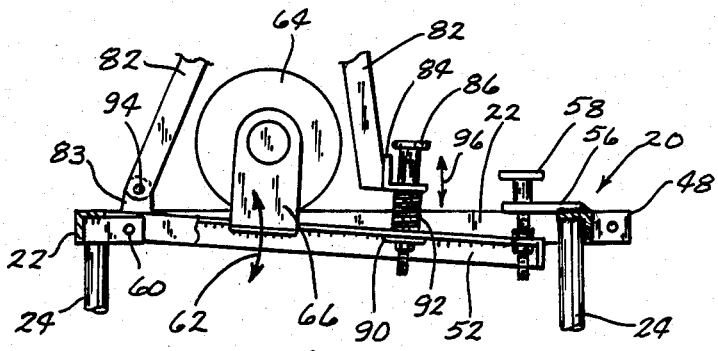
FIG. 4 is a sectional view taken along line 4—4 of FIG. 1 to clearly illustrate the tilting adjustment of the drive wheel supporting subframe with respect to the mainframe, and the pivoting adjustment of the pressure wheel supporting bracket with respect to the subframe.

Referring now to FIGS. 1 and 4, the subframe (50) includes a U-shaped member (52) pivotally attached to lugs (54) located at the rear of the mainframe (20). The forward end of the mainframe (20) carries a plate (56) which includes an opening disposed to receive a first threaded hand bolt (58). The shaft of the first hand bolt (58) is threadably received in the forward portion of the U-shaped member (52). As most clearly shown in FIG. 4, selective rotation of the first hand bolt (58) will cause the member (52) to pivot about pin (60) in the arc generally shown by the directional arrow (62). This pivotal adjustment allows for the adjustment of the tilt of the subframe (50) with respect to the mainframe (20).

The subframe (50) carries the drive means (64) supported by mounting brackets (66). The outport shaft (68) of the drive (64) is directly coupled to the drive wheel (70). Although other drives (64) could readily be used, the preferred drive (64) is a one-half horsepower, two speed, 110 volt electric motor. The preferred drive means (64) is operably connected to a power source through a switch box (65) which includes settings for high and low speeds.

The bracket (80) includes an A-frame member (82) pivotally attached to lugs (84) located at the rear of the subframe (50). The forward end of the A-frame member (82) carries a plate (84) having openings to receive a second threaded hand bolt (86) and a pair of upwardly extending elongated guides (88). The shaft of the second hand bolt (86) is threadably received in a lateral strap (90) which interconnects opposite sides of the U-shaped member (52). A compression spring (92) is carried on each of the guides (88) between the U-shaped member (52) and the plate (84). The springs (92) act to bias the bracket (80) away from the subframe (50).

The apex of the member (82) supports an outwardly extending shaft (98) that rotatably supports a pressure wheel (100). The pressure wheel (100) is suported in spaced radially aligned relationship with the drive wheel (70). As shown in FIG. 4, selective rotation of the second hand bolt (86) will cause the A-frame member (82) to pivot about pin (94) in an arc generally shown by the directional arrow (96). This adjustment allows for the adjustment of the spacing between the drive wheel (70) and the pressure wheel (100).

A support bar (102) is attached to member (82) and pivotally supports a guide tube (104) whose discharge end is disposed between the drive wheel (70) and the pressure wheel (100). A ball (106) fed through the guide tube (104) is ejected from the machine (10) at a trajectory and speed controlled by the selective adjustment of the first hand bolt (58) and the second hand bolt (86) and the selected speed of the drive motor (64).

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. In a ball pitching machine including a drive wheel and a pressure wheel supported in spaced radially aligned relationship on a mainframe, and a guide tube having a discharge end disposed intermediate said drive wheel and said pressure wheel, the improvement comprising:

a subframe pivotally attached to said mainframe, said subframe carrying a variable speed electric motor drive means having an output shaft directly coupled to said drive wheel;

means for selectively tilting said subframe with respect to said mainframe by pivoting said subframe to a number of selected positions, whereby the trajectory of a pitched ball is selectively adjusted; wherein said subframe tilting means includes a first threaded hand bolt journalled to rotate within an opening in said mainframe and having a threaded portion disposed to selectively engage a threaded opening in said subframe, whereby the subframe is selectively tilted with respect to said mainframe by rotation of said first hand bolt;

a bracket comprising an A-frame member pivotally attached at one end to said subframe, said A-frame member provided at its apex with an outwardly extending shaft attached to and rotatably supporting said pressure wheel; and, means for selectively pivoting said A-frame member with respect to said subframe; wherein said A-frame member pivoting means includes a second threaded hand bolt journalled to rotate within an opening in the other end of said A-frame member and having a threaded portion disposed to selectively engage a threaded opening in said subframe, and a compression spring disposed between said other end and said subframe biasing said A-frame member away from said subframe, whereby said A-frame member is selectively pivoted with respect to said subframe by rotation of said second hand bolt, thereby selectively adjusting the spacing between said drive wheel and said pressure wheel.

2. The ball pitching machine of claim 1; wherein, a pair of compression springs are disposed between said A-frame member and said subframe.

3. The ball pitching machine of claim 1 further including a tongue and handle pivotally attached to said mainframe and disposed to depend downwardly therefrom.

4. The ball pitching machine of claim 1 further including a retractable wheel assembly pivotally attached to said mainframe and movable between a raised position and a lowered ground engaging position, and a means for locking said wheel assembly in said lowered ground engaging position.

5. The ball pitching machine of claim 4; wherein, said wheel assembly locking means includes a rod having one end pivotally attached to said wheel assembly and having the opposite end selectively secured to said mainframe.

6. The ball pitching machine of claim 5; wherein, said opposite end of said rod is selectively secured to said mainframe by a set screw.

* * * * *